United States Patent [19]

Young et al.

[11] 4,089,619

[45] May 16, 1978

[54] TREADLE-OPERATED VACUUM SUPPLY DEVICE

[75] Inventors: Loring E. Young, Jefferson; William J. Siegel, Silver Spring, both of Md.

[73] Assignee: Pace Incorporated, Silver Spring, Md.

[21] Appl. No.: 599,034

[22] Filed: Jul. 25, 1975

Related U.S. Application Data

[63] Continuation-in-part of Ser. No. 464,436, Apr. 26, 1974, abandoned.

[51] Int. Cl.[2] ..... F04F 5/52; F16K 31/62

[52] U.S. Cl. ..... 417/54; 417/187; 417/312; 251/295

[58] Field of Search ..... 417/182, 187, 188, 189, 417/312, 54, 903; 251/295; 200/153 C; 38/40, 41; 32/33; 228/20; 15/409

[56] References Cited

U.S. PATENT DOCUMENTS

| | | | |
|---|---|---|---|
| 1,308,043 | 7/1919 | Cook | 200/153 C |
| 1,415,467 | 5/1922 | Pickop | 417/187 |
| 1,927,213 | 9/1933 | MacKenzie et al. | 417/312 |
| 2,091,642 | 8/1937 | Lingenbrink | 417/196 |
| 2,693,716 | 11/1954 | Ludwig | 251/295 |
| 3,169,499 | 2/1965 | Armanno | 228/20 |
| 3,489,390 | 1/1970 | Cadogan | 251/295 |
| 3,516,405 | 6/1970 | Hopper | 417/187 |
| 3,584,629 | 6/1971 | Hoef et al. | 15/409 |

FOREIGN PATENT DOCUMENTS

| | | | |
|---|---|---|---|
| 155,096 | 6/1932 | Germany | 200/153 C |

*Primary Examiner*—Carlton R. Croyle
*Assistant Examiner*—Thomas I. Ross
*Attorney, Agent, or Firm*—Gerald J. Ferguson, Jr.; Joseph J. Baker

[57] ABSTRACT

A vacuum control system is disclosed consisting of a pedal actuated valve connected between a source of air under pressure and a Venturi tube where the valve and the Venturi tube are enclosed within a base and a treadle member pivotally mounted on the base for actuating the valve. The Venturi tube has a port in which a vacuum is created upon actuation of the valve to its open position. Air ejected from the Venturi may be noiselessly diffused by porous filler material disposed adjacent the output side of the Venturi. Further, the ejected air is directed away from the foot and leg of the operator by enlarging the clearance between the forward edges of the treadle member and base while decreasing the clearance between the rear edges thereof when the treadle member is depressed to actuate the system.

11 Claims, 6 Drawing Figures

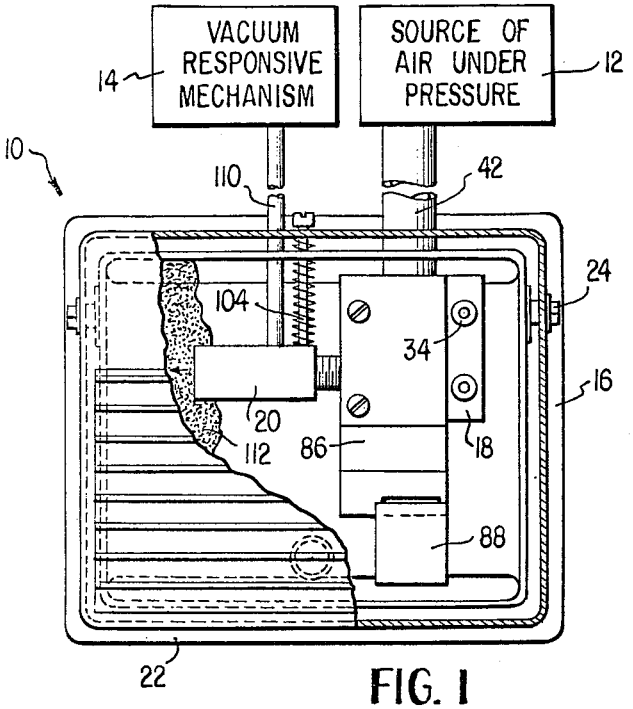
FIG. 1
FIG. 3
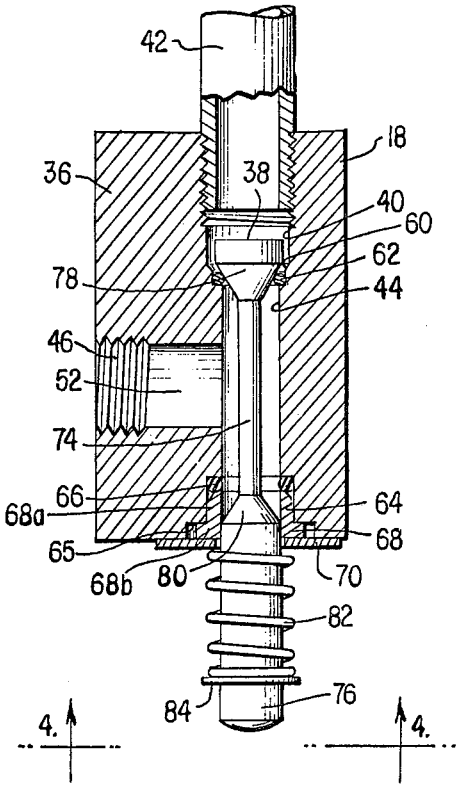
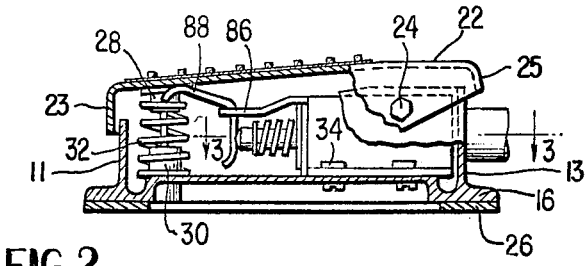
FIG. 2
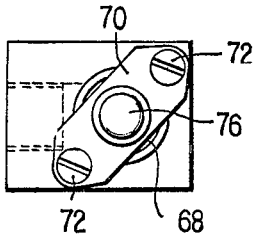
FIG. 4
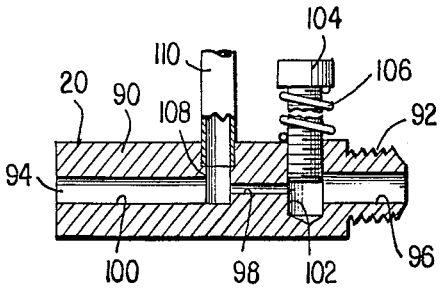
FIG. 5
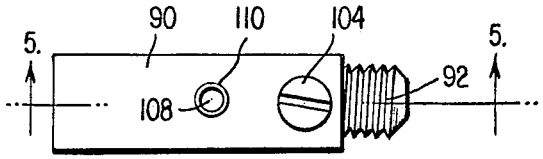
FIG. 6

TREADLE-OPERATED VACUUM SUPPLY DEVICE

REFERENCE TO RELATED APPLICATION

This application is a continuation-in-part of U.S. application Ser. No. 464,436 filed Apr. 26, 1974, now abandoned.

BACKGROUND OF THE INVENTION

Field of the Invention

This invention relates generally to fluid control systems and more particularly, but not by way of limitation, to a system for rapidly creating a source of suction by passing air under pressure through a Venturi tube and controlling suction by foot pedal actuation of a valve connected between the pressurized air and the Venturi tube.

SUMMARY OF THE INVENTION

The present invention contemplates a foot operated pedal which is operationally connected to a fluid control valve located between a source of compressed air and a vacuum creating device. In its more limited aspects, the invention contemplates a treadle assembly consisting of a base member and a pedal member for pivotal movement secured thereto. A fluid control valve body, having a longitudinal inlet bore and a transverse outlet bore, is mounted on the base member beneath the pedal member. A valve plunger is positioned within the inlet bore and is moved by the pedal member to permit pressurized air to enter the outlet bore. A Venturi tube having a serially connected upstream, throat, and downstream chambers is connected to the outlet of the fluid valve. A core communicating with the throat chamber has a suction created in it as a result of the passage through the throat chamber of pressurized air controlled by the fluid valve.

Therefore, it is an object of the present invention to provide a versatile system for rapidly creating and terminating a vacuum from pressurized air by actuation of a foot operated valve connected between the source of pressurized air and a vacuum creating device.

It is another object of the present invention to provide a foot operated vacuum supply and control system for use with pneumatically driven equipment thus freeing the operator's hands for other functions.

It is still another object of the present invention to provide such a vacuum supply and control system without the use of costly vacuum sources and solenoid actuated valves, switches and interconnecting wiring normally present in such systems of the prior art.

Finally, it is an object of the present invention to provide such a vacuum supply and control system which is relatively inexpensive to manufacture, which is rugged, and which has a minimum number of moving parts resulting in trouble free operation and minimum maintenence.

Other objects and advantages of the invention will be evident from the following detailed description when read in conjunction with the accompanying drawings which illustrate the invention.

BRIEF DESCRIPTION OF THE DRAWINGS

FIG. 1 is a plan view in partial section of the foot actuated vacuum control system of the present invention;

FIG. 2 is a side view also in partial section of the control system of FIG. 1;

FIG. 3 is a cross-sectional view of the valve of the control system taken along lines 3—3 of FIG. 2;

FIG. 4 is an end view of the valve of FIG. 3 taken along the lines 4—4;

FIG. 5 is a cross-sectional view of the Venturi tube of the present invention taken along the lines 5—5 of FIG. 6; and FIG. 6 is a plan view of the Venturi tube.

DETAILED DESCRIPTION OF THE PREFERRED EMBODIMENT

Referring now to the drawings where like numerals indicate like elements in each of the several figures, FIGS. 1 and 2 show the vacuum supply and control system of the present invention indicated generally by the numeral 10. In its assembled state, the system 10 might be connected between a source of air under pressure 12, such as a conventional air compressor and a vacuum responsive mechanism 14.

The vacuum supply and control system 10 comprises a base 16 on which is mounted the control valve 18 and interconnected Venturi tube 20. A treadle member 22 is secured to the base 16 by means of screws 24 which permit pivotal movement of the treadle relative to the base. The base 16 has a pad 26 of slip-resistant material on its lower surface which may be bonded thereto by any suitable means. The lower surface of the treadle member 22 has a projection 28 aligned with a similar projection 30 on the base 16. A coil spring 32 is held between the projections 28, 30 and serves to bias the treadle member 22 away from the base 16.

The control valve 18 is secured to the base 16 by means of screws 34. The valve body 36 of control valve 18 has a bore 38 extending longitudinally through the body. The bore 38 has a first or inlet chamber 40 to which suitable piping 42 can be attached for connection to the source of compressed air 12. The bore 38 has a second chamber 44 which contains the valving mechanism to be described shortly. The valve body 36 has an outlet or transverse partially threaded bore 46 communicating with the second chamber 44.

Second chamber 44 has a radially extending recess 60 adjacent one end thereof in which is positioned an O-ring real 62. The O-ring seal 62 serves as a first valve seat. The second chamber 44 also has a substantially larger radially extending recess 64 at its other end which has a shoulder 65 intermediate thereof. Another O-ring seal 66 is positioned at one end of recess 64 and serves as a second valve seat. A bushing 68, which is L-shaped in cross-section, has one leg **68*a* extending into recess 64 to hold the O-ring valve seat 66 in position, the other leg 68*b* of bushing 67 engages shoulder 65. A retaining plate 70 holds the bushing 68 in position within the recess 64 by means of screws 72**.

A valve plunger 74 is slidably positioned in the second chamber 44 and has an end 76 thereof extending through the retaining plate 70. The valve plunger 74 has a first valve head 78 and a second valve head 80 oppositely disposed and spaced-apart from each other. A compression spring 82 is positioned on the plunger 74 between the retaining plate 70 and a split retaining washer 84 adjacent the end 76. The spring 82 normally biases the first valve head 78 into sealing engagement with first O-ring valve seat 62 to thereby prevent compressed air in the first chamber 40 from entering the second chamber 44 and from there out transverse bore 46. As valve plunger 74 is moved against the bias of spring 82 by treadle member 22, in a manner to be more fully described later, second valve head 80 sealingly engages second O-ring valve seat 66 and first valved head 78 is separated from first O-ring valve seat 62. Pressurized air can now exit transverse bore 46 but is prevented by valve head 80 from leaving second chamber 44. A bracket 86 is secured to the valve body 36 substantially parallel to the valve plunger 74. The bracket 86 has a slot in which an L-shaped lever 88 is pivotably mounted. One end of the L-shaped lever 88 engages the underside of the treadle member 22 and the other end of the lever 88 engages the end 76 of the valve plunger 74. As can be seen, as the treadle member 22 is depressed, lever 88 moves the valve plunger 74 to its previously described open position.

The Venturi tube 20 has a housing 90 with a threaded end portion 92 for mating with threaded transverse bore 46. The housing 90 has a thru bore 94 which is divided into an upstream chamber 96, throat chamber 98 and downstream or vent chamber 100. The diameters of the upstream and downstream chambers 96, 100 respectively are substantially equal to each other, whereas, the diameter of the throat chamber 98 is approximately one-fourth the diameter of the upstream and downstream chambers. A threaded aperature 102 extends through the housing 90 to a point adjacent the area where the upstream chamber 96 meets the throat chamber 98. A threaded bolt 104 is positioned in the aperature 102 and serves, when rotated, as a valve to control the quantity of compressed air entering the throat chamber 98. A compression spring 106 is also provided on the bolt 104 to maintain the bolt in its desired position during shock or vibration of the entire assembly 10. A vacuum port 108 extends through the housing 90 to a point adjacent the area where the throat chamber 98 meets the downstream chamber 100. Suitable tubing 110 can then be connected between the vacuum port 108 and the vacuum responsive mechanism 14. It should be understood that any of a wide variety of materials may be used in the construction of various elements of the invention such as steel, brass or highly durable plastics. The O-ring valve seats 62, 64 can be made of rubber or other suitably compressable materials.

In order to direct the flow of air from Venturi tube 20 in a direction away from the leg and the foot of the operator, the treadle member 22, as can be readily seen in FIG. 2 is so shaped and so pivoted with respect to base 16 that air tends to flow out of the forward end of the assembly when treadle member 22 is depressed. This is effected, as will be explained in more detail hereinafter, by (a) downwardly extending rear edge or portion 23 and downwardly, outwardly extending forward edge or portion 25 of treadle member 22, (b) upwardly extending rear edge 11 and upwardly extending forward edge or portion 13 of base 10, and (c) the pivotal mounting of treadle member 22 with respect to base 10. As illustrated in FIG. 2, a small, first clearance is formed between rearward edges 11 and 23 while a clearance is formed between edges 13 and 25 which is large relative to a second clearance between edges 11 and 23.

The manner in which a vacuum is created in port 108 will now be described together with a description of the operation of the entire vacuum control system.

OPERATION

The control system 10 as disclosed is primarily suited to the rapid creation of suction or vacuum and the just as rapid termination thereof. Control may be from zero suction with the foot controlled valve 18 in its normal position as shown in FIG. 3 or full suction or vacuum force when the treadle member 22 is fully depressed by the operator's foot.

As the treadle member 22 is depressed, compressed air from source 12 passes between valve head 78 and valve seat 62, through transverse bore 46 and into the upstream chamber 96 of the Venturi tube 20. Simultaneously, valve head 80 engages valve seat 66 to prevent pressurized air from escaping from the other end of bore 44. Assuming bolt 104 is in a retracted position such that the end thereof is substantially even with the inside surface of upstream chamber 96, the full amount of pressurized air in upstream chamber 96 is forced into the throat chamber 98. Because throat chamber 98 is considerably smaller in diameter than upstream chamber 96 as aforesaid, the velocity of the pressurized air is greatly increased in the throat chamber. As the high velocity air under pressure exits the throat chamber 98, a vacuum or suction is created at the end of the throat chamber 98 adjacent vacuum port 108 due to the inability of the high velocity air to immediately expand and fill the larger downstream chamber 100. This vacuum can, as aforesaid, be used to drive a vacuum responsive mechanism 14. If varying amounts of suction are desired at port 108, bolt 104 can be rotated to partially close the entrance to throat chamber 98 which closure has the corresponding effect of decreasing the flow of air entering the throat chamber 98 thus decreasing the suction present at port 108.

The reexpanded air in downstream chamber 100, as well as any air sucked in through port 108, is expelled into the interior of the base and treadle assembly 16, 22 respectively (see arrow FIG. 1). If the noise of the air being expelled is objectionable, a pourous filler substance 112 (partially shown for clarity) may be packed adjacent the end of the downstream chamber 100 to diffuse the air noiselessly within the area between the treadle member 22 and base member 16.

Whether porous filler substance 112 is employed or not, the air ejected from downstream chamber 100 is directed away from the foot and leg of the operator to thereby lessen the possibility of dirt or other contaminants being directed thereat. In particular, when treadle member 22 is depressed, the intially small clearance between rearward edges 11 and 23 of base 10 and treadle member 22, respectively, is further decreased since edge 23 pivots toward edge 11 whereby rearward air flow toward the foot and leg of the operator is reduced to a harmless level, if not cut off all together. Further, the relatively large opening between forward edges 13 and 25 is increased so that the air flow tends to be forwardly directed away from the operator to thereby enhance safe operation of the device.

Changes may be made in the combination and arrangement of parts or elements as heretogore set forth in the specification and shown in the drawings; it being understood that changes may be made in the embodiment disclosed without departing from the spirit and scope of the invention as defined in the following claims.

What is claimed is:

1. A treadle actuated vacuum supply and control device connected to a source of compressed air, said device comprising:

a base member, a treadle member pivotally mounted with respect to said base member, said base and treadle members together forming an enclosure, valve means mounted within said enclosure beneath said treadle member, said valve means including an inlet connected to said source of compressed air, an outlet, and an actuating member responsive to depression of said treadle member for actuating said valve means to its open position; and Venturi means mounted within said enclosure connected to said outlet of the valve means, said Venturi means having a port in which a vacuum is created upon actuation of said valve means to its said open position by said depression of said treadle member, said Venturi device discharging the air exiting therefrom into said enclosure.

2. A treadle actuated vacuum supply and control device as in claim 1 including means for noiselessly diffusing the air leaving said Venturi means.

3. A device as in claim 1 including air directing means for directing air flow from said venturi device in a predetermined direction from said enclosure.

4. A device as in claim 3 including means for noiselessly diffusing air leaving said Venturi means.

5. A treadle actuated vacuum supply and control device connected to a source of compressed air, said device comprising:

a base member having (a) a horizontal portion, (b) spaced apart, vertically upstanding side portions and (c) spaced apart, vertically upstanding forward and rear portions;

a treadle member pivotally mounted with respect to said side portions of the base member, said treadle member including spaced apart, downwardly extending forward and rear portions, a first clearance being formed between the rear portions of said base and treadle members and a second clearance being formed between the forward portions thereof, said base and treadle members together effectively forming an enclosure;

valve means mounted within said enclosure beneath said treadle member, said valve means including an inlet connected to said source of compressed air, an outlet, and an actuating member responsive to depression of said treadle member for actuating said valve means to its open position; and Venturi means mounted within said enclosure connected to said outlet of the valve means, said Venturi means having a port in which a vacuum is created upon actuation of said valve means to its said open position by said depression of said treadle member, said first clearance being decreased and the second clearance being increased in response to said depression of the treadle member so that air flow from said Venturi means through said first clearance is substantially lessened with respect to that through said second clearance whereby air flow from said device is mostly through said second clearance whenever the device is actuated.

6. A device as in claim 5 where said forward portion of said treadle member is outwardly angled to further increase said flow of air through said second clearance.

7. A device as in claim 6 including means for noiselessly diffusing air leaving said Venturi means.

8. A method of supplying a vacuum to a predetermined point, said method comprising the steps of applying air under pressure to a valve means disposed within an enclosure comprising a base member and a treadle member pivotally mounted with respect to said base, said valve means being responsive to depression of said treadle member for actuation of the valve means to its open position;

depressing said treadle member with the foot of an operator to thereby open said valve means;

directing the output air from said valve means to a Venturi means disposed within said enclosure to thereby establish a vacuum in said Venturi means where the output air from the Venturi means is discharged into said enclosure; and supplying said vacuum to said predetermined point outside of said enclosure.

9. A method as in claim 8 including directing the output air from the Venturi means in a predetermined direction away from the leg of said operator.

10. A treadle actuated vacuum supply and control device connected to a source of compressed air, said device comprising:

a base member, a treadle member pivotally mounted with respect to said base member, said base and treadle members together forming an enclosure, valve means mounted within said enclosure beneath said treadle member, said valve means including an inlet connected to said source of compressed air, an outlet, and an actuating member responsive to depression of said treadle member for actuating said valve means to its open position;

Venturi means mounted within said enclosure connected to said outlet of the valve means, said venturi means having a port in which a vacuum is created upon actuation of said valve means to its said open position by said depression of said treadle member; and said base member including spaced apart, upwardly extending forward and rear portions, said treadle member includes spaced apart, downwardly extending forward and rear portions, a first clearance being formed between the rear portions of said base and treadle members and a second clearance being formed between the forward portions thereof, the first clearance being decreased and the second clearance being increased in response to said depression of said treadle member so that air flow from said Venturi means through said first clearance is substantially lessened with respect to that through said second clearance.

11. A device as in claim 10 where said forward portion of said treadle member is outwardly angled to further increase said flow of air through said second clearance.

* * * * *